US010177435B2

(12) United States Patent
Setomoto et al.

(10) Patent No.: US 10,177,435 B2
(45) Date of Patent: Jan. 8, 2019

(54) LUMINAIRE AND ILLUMINATION SYSTEM

(71) Applicant: PANASONIC INTELLECTUAL PROPERTY MANAGEMENT CO., LTD., Osaka (JP)

(72) Inventors: Tatsumi Setomoto, Osaka (JP); Tamotsu Ando, Osaka (JP); Hajime Ozaki, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/491,323

(22) Filed: Apr. 19, 2017

(65) Prior Publication Data

US 2017/0309987 A1 Oct. 26, 2017

(30) Foreign Application Priority Data

Apr. 25, 2016 (JP) ..... 2016-087471

(51) Int. Cl.

| | |
|---|---|
| ***H05B 33/08*** | (2006.01) |
| ***H01Q 9/42*** | (2006.01) |
| ***H01Q 21/28*** | (2006.01) |
| ***H01Q 1/22*** | (2006.01) |
| ***F21K 9/66*** | (2016.01) |

(Continued)

(52) U.S. Cl.

CPC ..... *H01Q 1/22* (2013.01); *F21K 9/275* (2016.08); *F21K 9/278* (2016.08); *F21K 9/66* (2016.08); *F21V 23/002* (2013.01); *H01Q 9/42* (2013.01); *H01Q 15/24* (2013.01); *H01Q 21/28* (2013.01); *H05B 33/0803* (2013.01); *F21V 29/89* (2015.01); *F21Y 2103/10* (2016.08); *F21Y 2115/10* (2016.08); *H05B 33/0842* (2013.01); *H05B 37/0272* (2013.01)

(58) Field of Classification Search

CPC .. H01Q 1/22; H01Q 15/24; F21K 9/66; F21K 9/275; F21K 9/278; F21V 23/002; F21V 29/89; F21Y 2103/10; H21Y 2115/10; H05B 33/0842; H05B 37/02772

USPC ..... 343/721

See application file for complete search history.

(56) References Cited

U.S. PATENT DOCUMENTS 8,508,149 B2 * 8/2013 Mohan ..... H05B 37/0272 315/194
2010/0280677 A1 * 11/2010 Budike, Jr. ..... H05B 37/0272 700/296

FOREIGN PATENT DOCUMENTS

JP 2010-81167 4/2010
JP 2011-96408 5/2011

(Continued)

*Primary Examiner* — Khai M Nguyen

(74) *Attorney, Agent, or Firm* — Greenblum & Bernstein, P.L.C.

(57) ABSTRACT

A luminaire includes: a light-emitting module; a base having a front surface on which the light-emitting module is disposed; a cover which is translucent and covers the light-emitting module; a controller which is disposed on a back surface of the base and controls the light-emitting module; a first antenna which transmits and receives a first polarized wave; and a control wire which connects the controller and the first antenna. The control wire includes an exposed portion which is a portion of the control wire in a longitudinal direction of the control wire and which is disposed between the base and the cover to transmit and receive a second polarized wave that differs from the first polarized wave in a polarization direction.

11 Claims, 8 Drawing Sheets

(51) Int. Cl.

| | |
|---|---|
| ***F21K 9/275*** | (2016.01) |
| ***F21K 9/278*** | (2016.01) |
| ***F21V 23/00*** | (2015.01) |
| ***H01Q 15/24*** | (2006.01) |
| *F21V 29/89* | (2015.01) |
| *F21Y 103/10* | (2016.01) |
| *F21Y 115/10* | (2016.01) |
| *H05B 37/02* | (2006.01) |

(56) References Cited

FOREIGN PATENT DOCUMENTS

| | | |
|---|---|---|
| JP | 2014-167878 | 9/2014 |
| JP | 2015-37042 | 2/2015 |
| JP | 2015-69774 | 4/2015 |

* cited by examiner

LUMINAIRE AND ILLUMINATION SYSTEM

CROSS REFERENCE TO RELATED APPLICATION

This application claims the benefit of priority of Japanese Patent Application Number 2016-087471 filed on Apr. 25, 2016, the entire content of which is hereby incorporated by reference.

BACKGROUND

1. Technical Field

The present disclosure relates to a luminaire and an illumination system which are controllable according to illumination function by wireless communication.

2. Description of the Related Art

Conventionally, a luminaire is known which includes a light source that emits light, a cover that covers the light source, a pattern antenna that is an example of a first antenna and performs wireless communication, a wireless communication controller that is an example of a controller, and a lead wire that is an example of a control wire (see Patent Literature (PTL) 1: Japanese Unexamined Patent Application. Publication No. 2014-167878, for example).

SUMMARY

There is, however, a demand for improving communication performance of the luminaire disclosed PTL 1.

The present disclosure has an object to provide a luminaire and an illumination system which make it possible to increase a gain by using a control wire as an antenna so as to improve communication performance.

A luminaire according to one aspect of the present disclosure includes: a light-emitting module; a base having a front surface on which the light-emitting module is disposed; a cover which is translucent and covers the light module; a controller which is disposed on a back surface of the base and controls the light-emitting module; a first antenna which transmits and receives a first polarized wave; and a control wire which connects the controller and the first antenna, wherein the control wire includes an exposed portion which is a portion of the control wire in a longitudinal direction of the control wire and which is disposed between the base and the cover to transmit and receive a second polarized wave that differs from the first polarized wave in a polarization direction.

Moreover, an illumination system according to one aspect of the present disclosure includes: a plurality of luminaires; and a terminal device capable of controlling the plurality of luminaires.

The luminaire and the illumination system according to the aspects of the present disclosure make it possible to increase a gain by using a control wire as an antenna so as to improve communication performance.

BRIEF DESCRIPTION OF DRAWINGS

The figures depict one or more implementations in accordance with the present teaching, by way of examples only, not by way of limitations. In the figures, like reference numerals refer to the same or similar elements.

Figure 10:
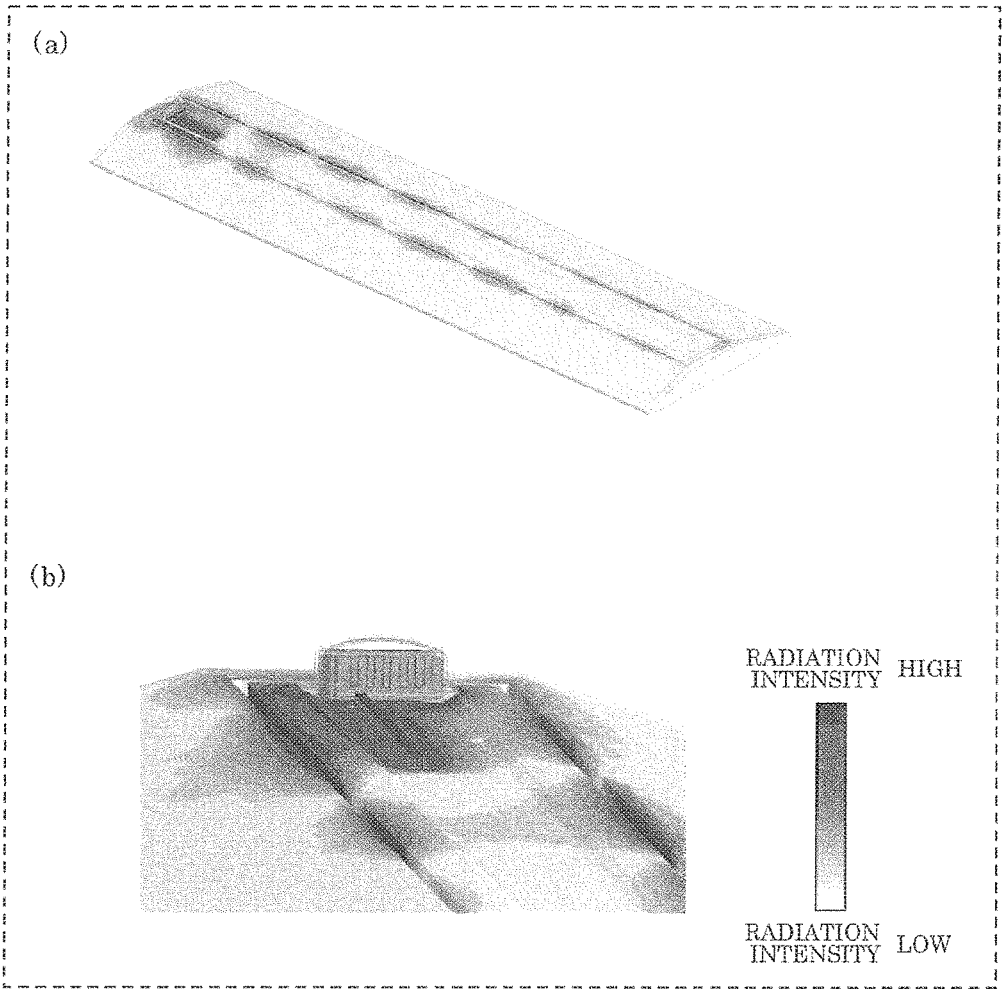
Figure 11:
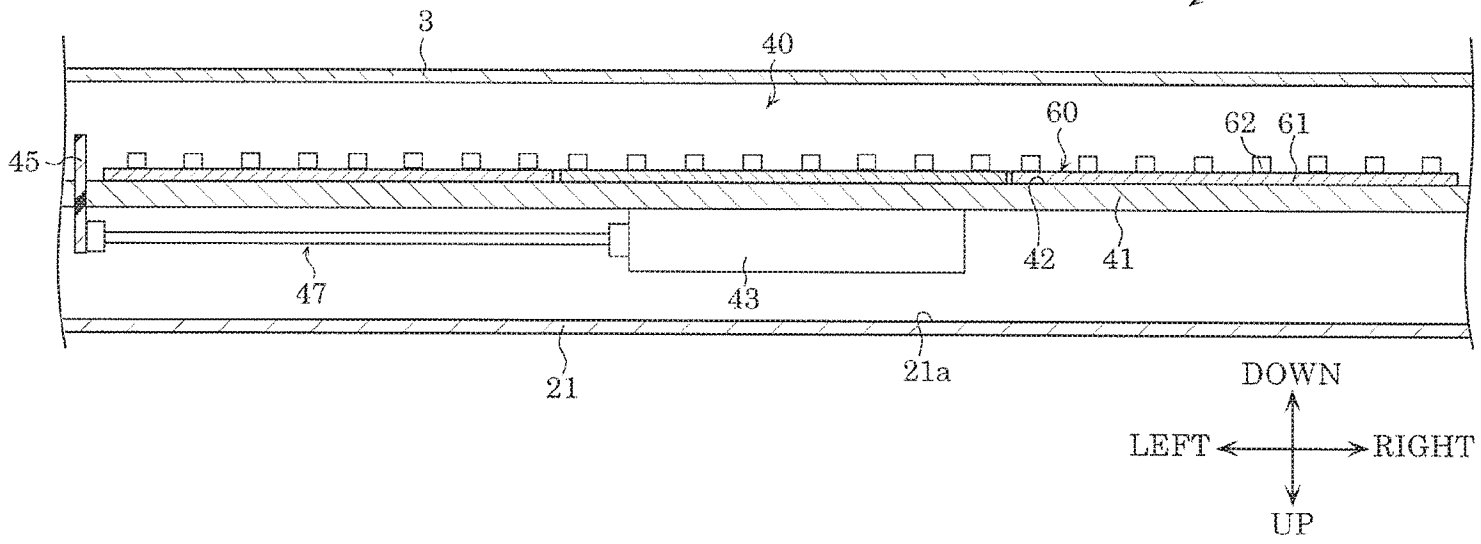
Figure 12:
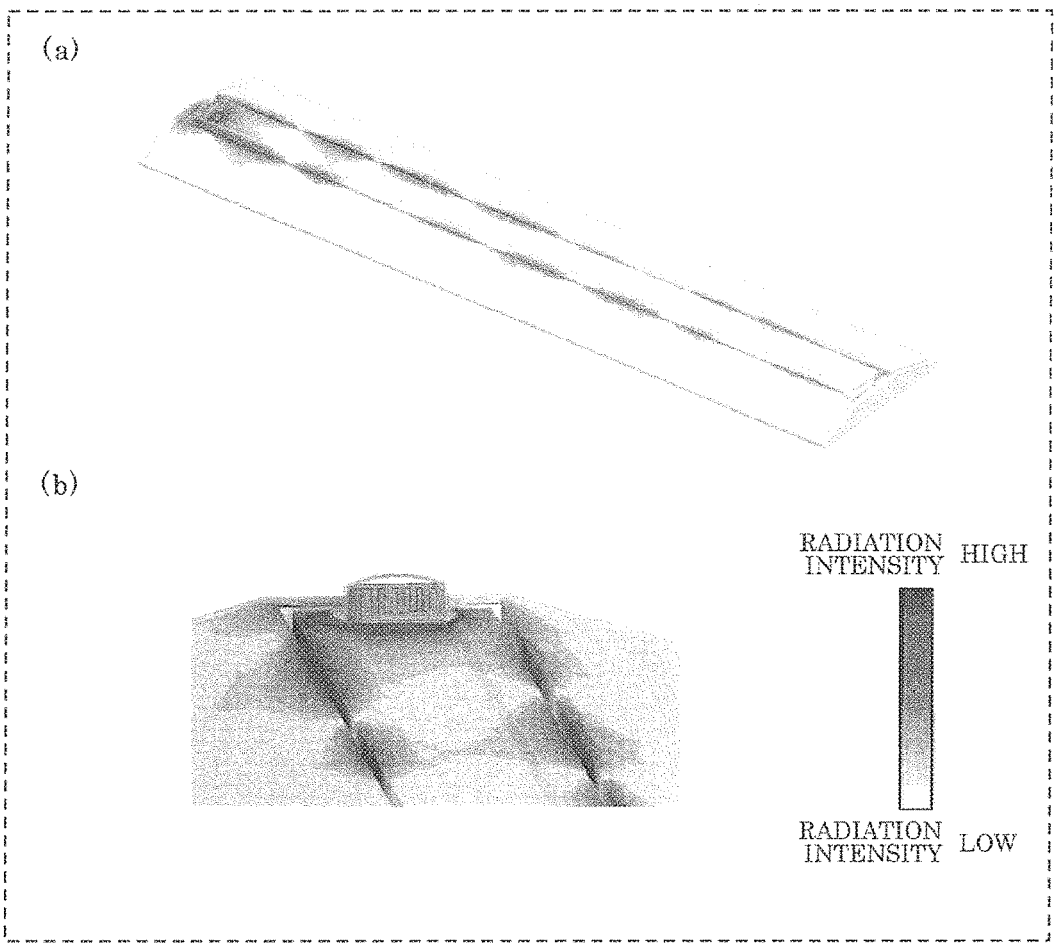
Figure 13:
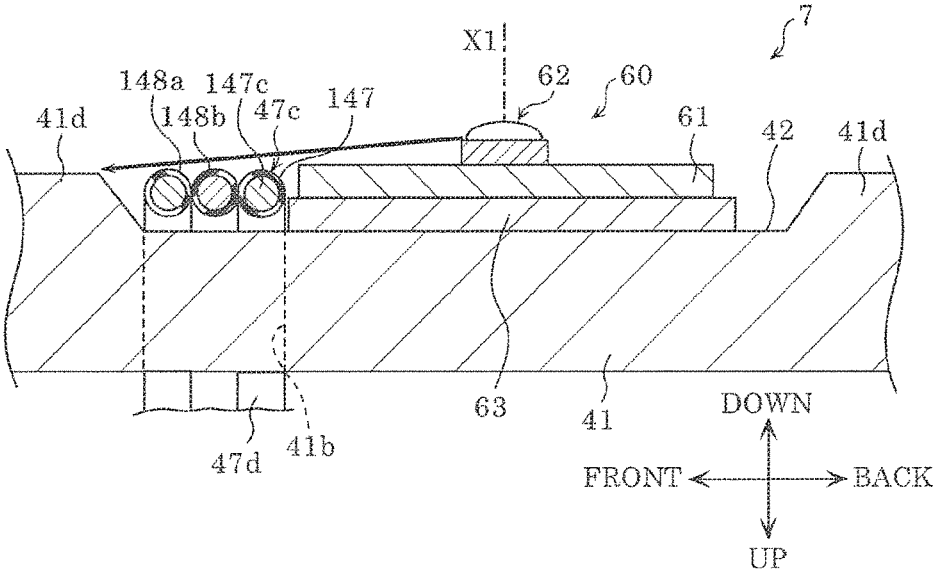
Figure 14:
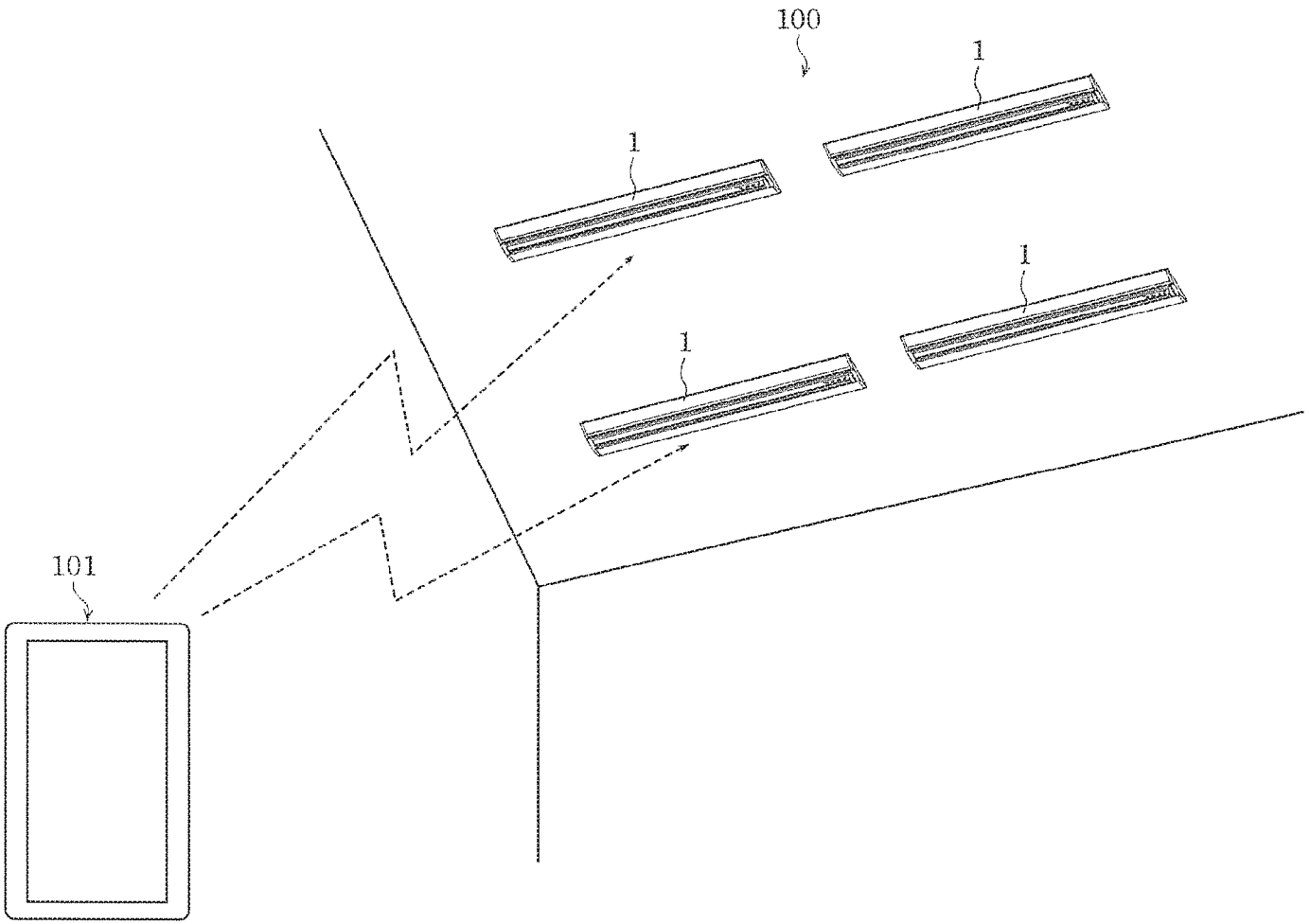

(a) of FIG. 10 is a perspective view illustrating the radiation intensities of the first antenna and the second antenna in the luminaire according to the embodiment, and (b) of FIG. 10 is a partially enlarged perspective view illustrating the radiation intensities of the first antenna and the second antenna in the luminaire according to the embodiment;

FIG. 11 is a partial cross-sectional view illustrating a luminaire according to a comparative example;

(a) of FIG. 12 is a diagram illustrating the radiation intensity of a first antenna in the luminaire according to the comparative example, and (b) of FIG. 12 is a diagram illustrating the radiation intensity of the first antenna in the luminaire according to the comparative example;

FIG. 13 is a cross-sectional view illustrating a state in which a cover is removed from a luminaire according to variation 1 of the embodiment; and FIG. 14 is a schematic diagram illustrating an illumination system including luminaires according to variation 2 of the embodiment.

DETAILED DESCRIPTION OF THE EMBODIMENTS (Underlying Knowledge Forming Basis of the Present Disclosure)

In a luminaire, an antenna such as a first antenna is usually disposed in a position at which the antenna is not easily seen or a position at which the antenna cannot be seen, according to the nature of the luminaire and in terms of design or light distribution characteristics. It is desirable that to ensure communication performance, the first antenna be disposed at an end of a space between a cover and a base (light bar) which fixes a circuit board on which a light source is mounted.

Moreover, from a standpoint of workability of replacing the base, a controller is usually housed on an opposite side of the light source in the luminaire and disposed near the center of the base.

In the luminaire having such a structure, it is necessary to dispose, from the first antenna disposed at the end of the base to the controller, a control wire which connects the first antenna and, the controller that controls the first antenna. The control wire includes a power wire, a signal wire, and a ground wire, and simultaneously radiates radio waves when the first antenna radiates radio waves.

Typically, in the luminaire, because the control wire connecting the first antenna and the controller is housed in a casing, the control wire is not exposed from the base. In other words, when the control wire is used as an antenna, it is impossible to ensure sufficient communication performance because the base becomes an obstacle and communication is performed via a space of the base, the casing, etc. In particular, if the base is made of metal, it is difficult to use the control wire as the antenna.

In view of this, the present disclosure provides a luminaire and an illumination system which make it possible to increase a gain by using a control wire as an antenna so as to improve communication performance.

Hereinafter, embodiments of the present disclosure will be described with reference to the drawings. It is to be noted that the embodiments described below each shows a specific example of the present disclosure. The numerical values, shapes, materials, structural elements, the arrangement and connection of the structural elements, etc. indicated in the following embodiments are mere examples, and therefore are not intended to limit the present disclosure. Therefore, among the structural elements in the following embodiments, structural elements not recited in any of the independent claims defining the most generic concept of the present disclosure are described as optional structural elements.

It is to be noted that the figures are schematic diagrams and are not necessarily precise illustrations. In addition, substantially the same elements share the same reference signs in the figures, and overlapping description is omitted or abridged.

Embodiment

Hereinafter, a configuration of a luminaire according to an embodiment will be described with reference to FIG. 1 to FIG. 6.

Configuration

Figure 1:
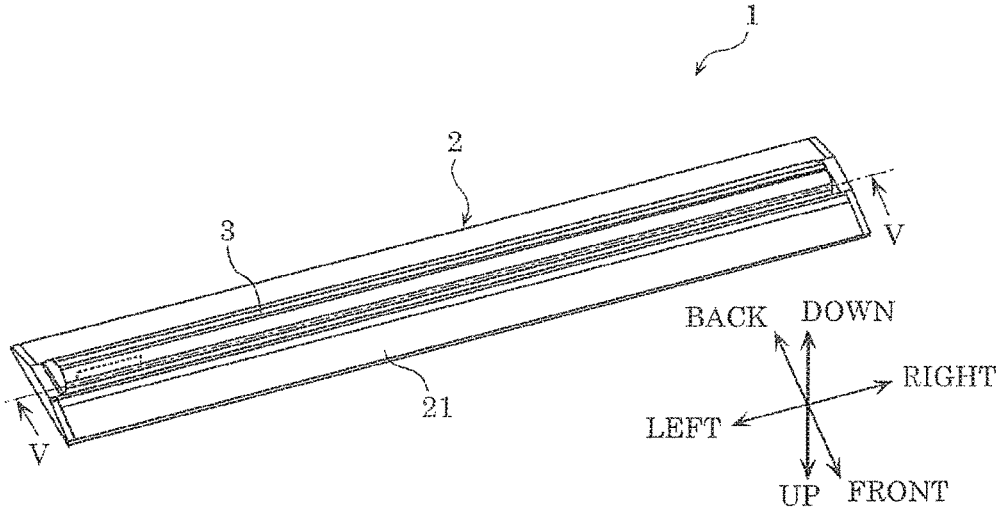
FIG. 1 is a perspective view illustrating a luminaire according to an embodiment.
Figure 2:
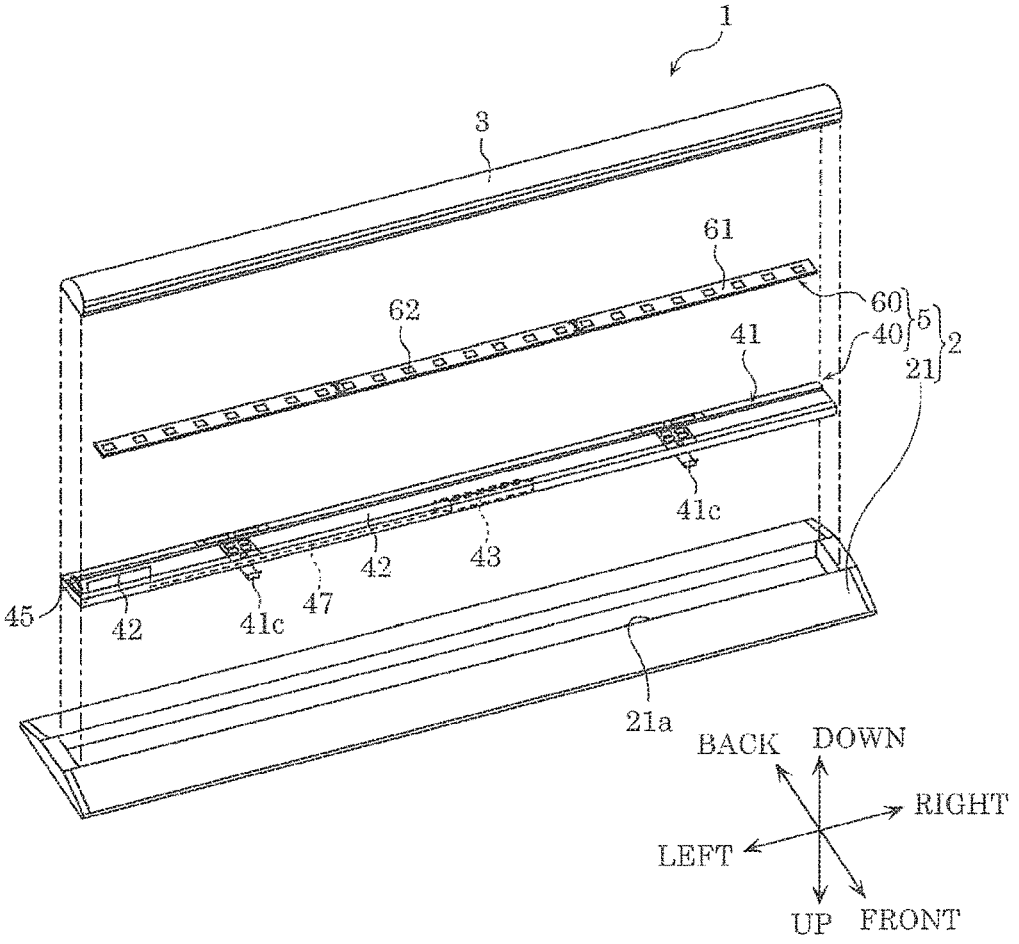
FIG. 2 is an exploded perspective view illustrating the luminaire according to the embodiment.
Figure 3:
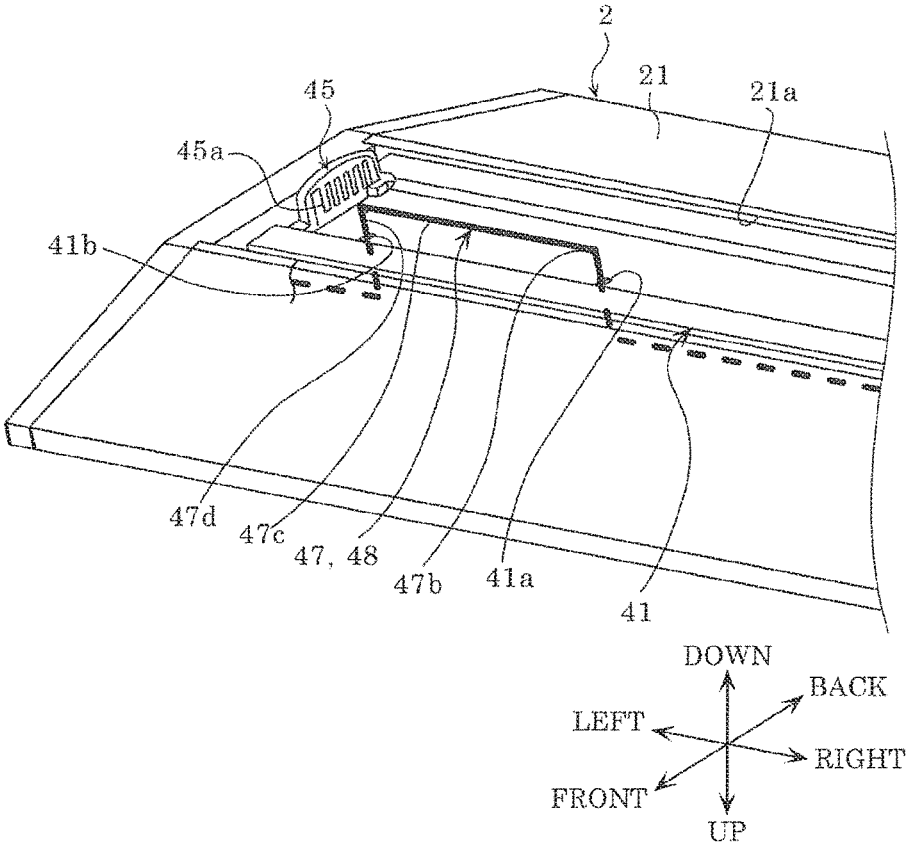
FIG. 3 is a partially enlarged perspective view illustrating a state in which a cover is removed from the luminaire according to the embodiment.
Figure 4:
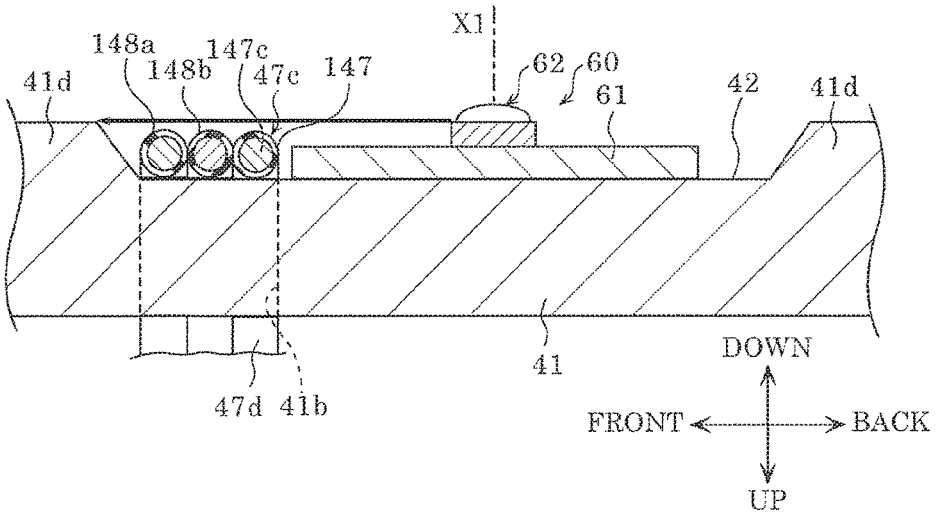
FIG. 4 is a cross-sectional view illustrating the state in which the cover is removed from the luminaire according to the embodiment, taken along line IV-IV in FIG. 5.
Figure 5:
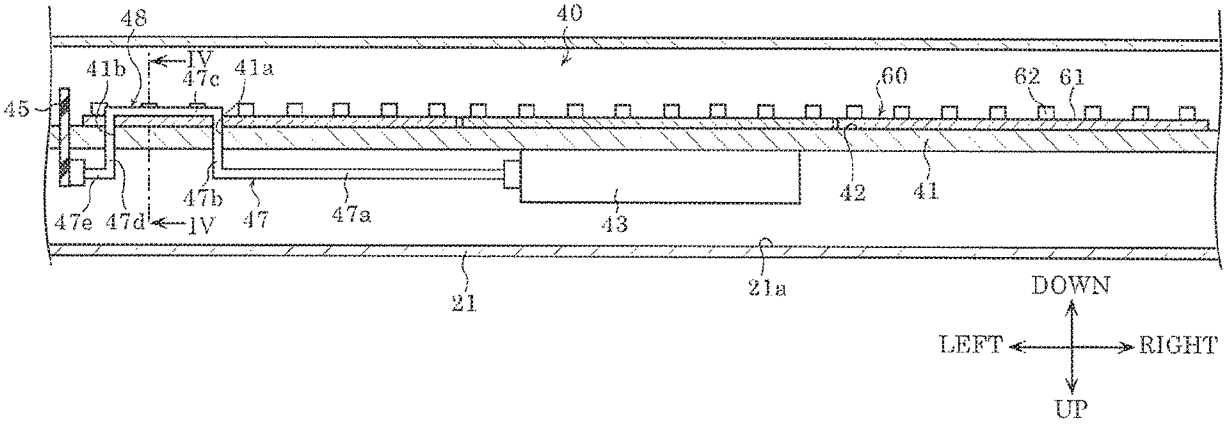
FIG. 5 is a partial cross-sectional view illustrating the luminaire according to the embodiment, taken along line V-V in FIG. 1.
Figure 6:
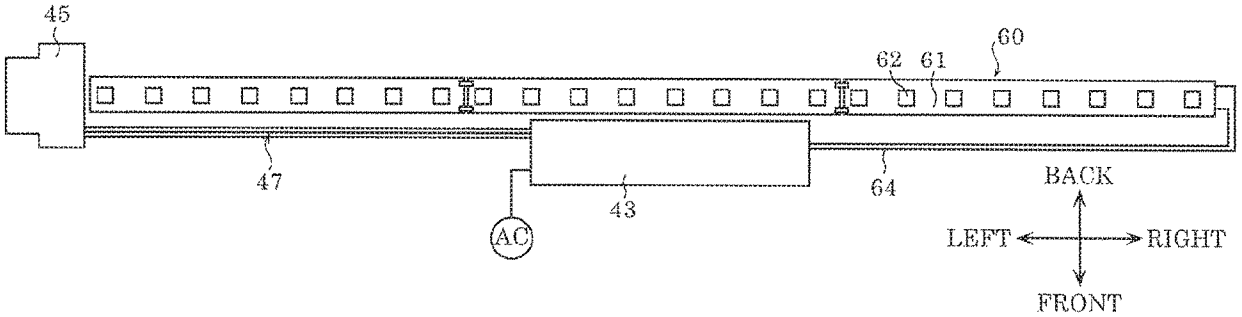
FIG. 6 is a front view illustrating a light-emitting module, a controller, a first antenna, a controller, etc. of the luminaire according to the embodiment.

FIG. 1 is a perspective view illustrating luminaire 1 according to the embodiment. FIG. 2 is an exploded perspective view illustrating luminaire 1 according to the embodiment. FIG. 3 is a partially enlarged perspective view illustrating a state in which cover 3 is removed from luminaire 1 according to the embodiment. FIG. 4 is a cross-sectional view illustrating the state in which cover 8 is removed from luminaire 1 according to the embodiment, taken along line IV-IV in FIG. 5. FIG. 5 is a partial cross-sectional view illustrating luminaire 1 according to the embodiment, taken along line V-V in FIG. 1. FIG. 6 is a front view illustrating light-emitting module 60, controller 43, first antenna 45*a*, control wire 47, etc. of luminaire 1 according to the embodiment.

In FIG. 1, a side of the first antenna of the luminaire is defined as the left, a side opposite the side of the first antenna is defined as the right, and front-back, horizontal, and vertical directions are indicated. Directions indicated in each of the figures subsequent to FIG. 1 all correspond to the directions indicated in FIG. 2 and the subsequent figures. It is to be noted that because, in FIG. 1, the vertical, horizontal, and front-back directions change according to the usage of a user, directions are not limited to these directions. The same amities to the figures subsequent to FIG. 1. In addition, the horizontal direction in the embodiment is an example of a longitudinal direction.

As illustrated in FIG. 1, luminaire 1 is an LED lamp having an elongated shape, and is used in, for example, a state in which luminaire 1 is fixed to a ceiling with a fixing component such as a screw.

Luminaire 1 includes body 2 and cover 3. Body 2 is a component serving as a base for luminaire 1. Body 2 includes casing 21 and lighting device 5.

Casing 21 has an elongated shape and a substantially symmetrical trapezoidal shape when a plane defined by the vertical and front-back directions is viewed cross-sectionally. Casing 21 includes housing portion 21*a* which is recessed upward from the under surface of casing 21. Housing portion 21*a* is a recess extending in the horizontal direction. Housing portion 21*a* houses controller 43, base 41, light-emitting module 60, control wire 47, etc. which will be described below in connection with lighting device 5. Controller 43, base 41, light-emitting module 60, and cover 3 are disposed downward in listed order from the bottom surface of housing portion 21*a*. Light-emitting module 60 and base 41 constitute a light bar.

Lighting device 5 includes device body 40 and light-emitting module 60.

Device body 40 includes base 41, controller 43, wireless module 45, and control wire 47.

Base 41 is a frame which is elongated in the horizontal direction and which is made of ceramic, resin into which filer metal is mixed, or metal such as aluminum and iron, etc. in the embodiment, base 41 is made of metal such as iron to dissipate heat of light-emitting module 60. In this case, for example, base 41 is formed into a predetermined shape by rolling or pressing, etc. SPCC (Steel Plate Cold Commercial) sheet metal (metal plate). It is to be noted that base 41 is not necessarily limited to a base made of only metal, and may be made of a material other than metal.

Base 41 includes, along the horizontal direction, step portions 411 which make a pair in the front-back direction. The pair of step portions 41*d* forms recess 42. Specifically, recess 42 is recessed in a direction from the front surface (under surface) of base 41 to the bottom surface of casing 21 (upward). The pair of step portions 414 is a protrusion protruding downward. In addition, recess 42 extends in the horizontal direction such that circuit board 61 of light-emitting module 60 can be mounted on recess 42. Light-emitting module 60 is mounted on recess 42 which is the front surface of base 41. Circuit hoard 61 is supported by base 41 by mounting circuit board 61 of light-emitting module 60 on base 41 and fixing circuit board 61 to base 41.

It is desirable that the pair of step portions 41*d* not be in a direction substantially perpendicular to optical axis X1 of light source 62 when light-emitting module 60 is disposed in recess 42. If the pair of step portions 41*d* is in the direction substantially perpendicular to optical axis X1 of light source 62, the pair of step portions 41*d* casts a shadow. For this reason, it is desirable that the pair of step portions 41*d* be provided to block light traveling in the direction substantially perpendicular to optical axis X1.

As illustrated in FIG. 3, base 41 includes first insertion hole 41*a* and second insertion hole 41*b* through which control wire 47 can be inserted. First insertion hole 41*a* and second insertion hole 41*b* line up in the horizontal direction on the left side of base 41. Moreover, first insertion hole 41*a* is on the right side of second insertion hole 41*b*. Furthermore, first insertion hole 41*a* and second insertion hole 41*b* are outside of the outer periphery of circuit board 61 in a state where circuit board 61 of light-emitting module 60 is mounted on recess 42. In other words, when the state in which circuit board 61 of light-emitting module 60 is mounted on recess 42 is viewed from the front, first insertion hole 41*a* and second insertion hole 41*b* do not overlap with (do not cover) circuit board 61 of light-emitting module 60.

Moreover, first insertion hole 41*a* and second insertion hole 41*b* have the inner diameter slightly larger than the outer diameter of control wire 47. In other words, the inner diameter of first insertion hole 41*a* and second insertion hole 41*b* is large to the extent that control wire 47 inserted through first insertion hole 41*a* and second insertion hole 41*b* does not wobble.

As illustrated in FIG. 2, base 41 is removably attached to casing 21. Base 41 has two engaging portions 41*c* which project forward. Base 41 and casing 21 are fixed by engaging, on a one-to-one, basis, two engaging portions 41 with two cutout portions formed in housing portion 21*a* of casing 21. It is to be noted that base 41 and casing 21 may be fixed with, for example, a fixing component such as a screw.

Moreover, a connector is provided to an end of an electrical wire extending in casing 21 of body 2, and a connector is provided to an end of an electrical wire extending in lighting device 5. Electric power necessary for lighting device 5 to emit light is supplied from body 2 to lighting device 5 by fitting the connector of body 2 and the connector of lighting device 5.

Controller 43 is disposed between the back surface (top surface) of base 41 and the bottom of housing portion 21*a*. Controller 43 is disposed in the vicinity of the central portion of base 41 in the horizontal direction. Controller 43 controls operations such as turning on, turning off, dimming (brightness adjustment), and toning (emission color (color temperature) adjustment) of light-emitting module 60, according to an instruction (control signal via a remote controller etc.) from a user. Controller 43 performs these operations using, for example, a microcomputer, a processor, or a dedicated circuit which controls a current value etc. supplied to light-emitting module 60 according to an inputted signal.

Wireless module 45 has a flat plate shape and is provided substantially parallel to a plane defined by the vertical direction and the horizontal direction. Specifically, because first antenna 45*a* of wireless module 45 extends in a direction (vertical plane) substantially perpendicular to a ground surface, first antenna 45*a* serves as a pattern antenna capable of transmitting and receiving a vertically polarized wave (an example of a first polarized wave). It is to be noted that the vertical plane is also vertical to the under surface of base 41 in the embodiment. In addition, first antenna 45*a* is also substantially vertical to base 41. First antennas 45*a* is an antenna capable of transmitting a carrier of a vertically polarized wave. Wireless module 45 is attached to the left end of base 41. First antenna 45*a* of wireless module 45 is provided between cover 3 and base 41. In other words, wireless module 45 is disposed to penetrate base 41, first antenna 45*a* of wireless module 45 is disposed to be exposed from base 41, and the other structural elements are disposed in housing portion 21*a* between casing 21 and base 41.

Wireless module 45 receives a control signal via an external terminal device such a remote controller, and transmits a request for a program for controlling light-emitting module 60. It is to be noted that wireless module 45 may be, for example, a communication module for communicating with a program distribution server via the Internet. In addition, a communication device such as a modem, a router, and a relay server may be between wireless module 45 and the program distribution server in reality.

It is to be noted that controller 43 may be connected to a storage. The storage may be a rewritable (non-volatile) memory device into which a program received by wireless module 45 is stored. A semiconductor memory such as a flash memory and an electrically erasable programmable read-only memory (EEPROM) is used as an example of the storage. It is to be noted that the storage may be provided in controller 43.

Control wire 47 includes power wire 148*a*, signal wire 148*b*, and ground wire 147 (multiple wires) each of which includes a metal wire such as a copper wire covered with an insulative covering body such as rubber, and extends in the horizontal direction to electrically connect wireless module 45 and controller 43. Control wire 47 extends along base 41. As illustrated in FIG. 5, control wire 47 includes first control wire 47*a*, second control wire 47*b*, third control wire 47*c*, fourth control wire 47*d*, and fifth control wire 47*e*, and continues in order of first to fifth control wires 47*a* to 47*e*.

First control wire 47*a* extends in the horizontal direction. First control wire 47*a* has the right end connected to the left end of controller 43 via a connector. Second control wire 47*b* bends substantially vertically relative to first control wire 47*a* from the left end of first control wire 47*a*, and extends downward. In other words, second control wire 47*b* extends in the vertical direction that is substantially vertical relative to first control wire 47*a* extending in the horizontal direction. Moreover, second control wire 47*b* penetrates first insertion hole 41*a*, and part of second control wire 47*b* is provided between base 41 and cover 3. Stated differently, second control wire 47*b* is disposed to penetrate base 41, and the part of second control wire 47*b* is exposed from base 41. Third control wire 47*c* extends leftward (toward wireless module 45) from the lower end of second control wire 47*b*. In other words, third control wire 47*c* extends in the horizontal direction that is substantially vertical relative to second control wire 47*b* extending in the vertical direction, and is substantially parallel to first control wire 47*a*. Fourth control wire 47*d* bends substantially vertically relative to third control wire 47*c* from the left end of third control wire 47*c*, and extends upward. In other words, fourth control wire 47*d* extends in the vertical direction that is substantially vertical relative to third control wire 47*c* extending in the horizontal direction, and is substantially parallel to second control wire 47*b*. Moreover, part of fourth control wire 47*d* penetrates second insertion hole 41*b* and is provided between base 41 and cover 3. Stated differently, fourth control wire 47*d* is disposed to penetrate base 41, and the part of fourth control wire 47*d* is exposed from base 41. Fifth control wire 47*e* extends leftward from the upper end of fourth control wire 47*d*, and has the left end connected to wireless module 45 via a connector. The part of second control wire 47*b* (between base 41 and cover 3), third control wire 47*c*, and the part of fourth control wire 47*d* (between base 41 and cover 3) are an example of exposed portion 48. Moreover, exposed portion 48 has the right end (one end) which is the part of second control wire 47*b* (between base 41 and cover 3) and is the right side of exposed portion 48. Furthermore, exposed portion 48 has the left end (the other end) which is the part of fourth control wire 47*d* (between base 41 and cover 3) and is the left side of exposed portion 48. In other words, exposed portion 48 has the right end connected to controller 48 via first insertion hole 41*a*. In addition, exposed portion 48 is connected to wireless module 45 via second insertion hole 41*b*.

Third control wire 47*c* is linear. Moreover, third control 47*c* (second antenna 147*c* to be described below) extends to be substantially perpendicular to first antenna 45*a* of wireless module 45. In other words, third control wire 47*c* extending in the horizontal direction is substantially perpendicular to the plane defined by the vertical direction and the front-back direction. Specifically, ground wire 147 of third control wire 47*c* is grounded on a side opposite controller 43. Moreover, ground wire 147 of third control wire 47*c* extends half-wavelength long in the horizontal direction that is horizontal relative to the ground surface. For this reason, ground wire 147 of third control wire 47*c* serves like a dipole antenna capable of transmitting and receiving a horizontally polarized wave (an example of a second polarized wave) differing from a vertically polarized wave in a polarization direction. In other words, ground wire 147 of third control wire 47*c* is second antenna 147*c*. As stated above, first antenna 45*a* and second antenna 14'7*c* constitute a diversity antenna. It is to be noted that using control wire 47 as the antenna means ground wire 147 of third control wire 47*c* included in control wire 47, not using all of control wire 47 as the antenna.

As illustrated in FIG. 4, third control wire 47*c* includes power wire 148*a*, signal wire 148*b*, and ground wire 147 as above. Ground wire 147 of third control wire 47*c* includes second antenna 147*c*. Second antenna 147*c* is a metal wire covered with a covering body and is disposed not to be in contact with base 41. Specifically, second antenna 147*c* of third control wire 47*c* is provided to be separated from base 41 and substantially parallel to the bottom surface of recess 42 in base 41. It is to be rioted that third control wire 47*c* may or may not be in contact with base 41. In addition, it is desirable that base 41 be above third control wire 47*c*. In other words, it is desirable that first insertion hole 41*a* and second insertion hole 41*b* be not a continuous hole.

Moreover, exposed portion 48 is housed in recess 42 to avoid blocking light from light source 62 to be described below. Specifically, exposed portion 48 is disposed between recess 42 and circuit board 51, and is not on a straight line connecting light source 62 and the front surface of base 41 excluding recess 42. The front surface of base 41 excluding recess 42 is a surface on a side where light source 62 of base 41 is disposed, and is the surface of base 41 other than recess 42.

As illustrated in FIG. 6, light-emitting module 60 is electrically connected to controller 43 via LED power wire 64. Light-emitting module 60 has a long flat plate shape, includes light sources 62 and circuit board 61 on which light sources 62 are mounted, and is capable of performing dimming control and toning control. In the embodiment, eight light sources 62 are provided in line on each of three circuit boards 61. Circuit boards 61 align in the horizontal direction. Central circuit board 61 has the right end electrically connected to the left end of one of two circuit boards 61, and the left end electrically connected to the right end of the other of two circuit boards 61.

Light sources 62 are mounted in line on each of circuit boards 61. Each of light sources 62 is a surface-mount device (SMD) LED element. Specifically, the SMD LED element is a packaged LED element in which an LED chip (light-emitting element) is mounted inside a resin-molded cavity, and a phosphor-containing resin is filled into the cavity. Controller 43 provided to lighting device 5 causes light sources 62 to turn on and turn off. In addition, controller 43 causes a power supply device to dim and tone each light source 62.

Circuit board 61 is a mounting board for mounting light sources 62, and is, for example, a ceramic board, a resin board, or a metal base board covered with an insulating film. Moreover, circuit board 61 has, for example, a plate shape with a flat surface which is rectangular in a plan view. It is to be noted that circuit board 61 includes a pair of electrode terminals (a positive electrode terminal and a negative electrode terminal) for receiving, from an external source, direct current power for causing light sources 62 to emit light.

Controller 43 includes the power supply device which supplies electric power for causing light sources 62 to emit light. The power supply device includes a power supply circuit which generates electric power. The power supply device also includes a circuit board such as a printed-circuit board, and electronic components mounted on the circuit board. The power supply device converts alternating current power from an external power source (AC in FIG. 6) such as a commercial power source into direct current power having a predetermined level by, for example, rectifying, smoothing, and stepping down, etc. the alternating current; power, and supplies the converted direct current power to light-emitting module 60.

It is to be noted that the power supply device need not be included in controller 43, and may be provided above base 41 (between base 41 and casing 21). In other words, the power supply device may be electrically connected to controller 43 and housed in housing portion 21*a* of casing 21. The power supply device and circuit boards 61 are separated from one another via base 41. The power supply device is electrically connected to light sources 62 via, for example, a connector. The connector is a circuit board connector for feeding electric power to light-emitting module 60 (circuit hoards 61 and light sources 62).

Cover 3 is a member which covers light-emitting module 60 and is a translucent member which transmits light emitted by light-emitting module 60. Cover 3 is made of, for example, a translucent resin material such as acryl and polycarbonate or a translucent material such as a transparent glass material. Moreover, in the embodiment, cover 3 has a function to diffuse light emitted by light-emitting module 60. For example, a milky white light diffusion film is formed on cover 3 by applying a resin or white pigment containing a light diffusion material (fine particles) such as silica and calcium carbonate, onto the inner or outer surface of cover 3. Furthermore, cover 3 itself may be formed of a resin material in which a light diffusion material etc. is dispersed.

It is to be noted that cover 3 which diffuses light may be configured by forming a milky white light diffusion film containing a light diffusion material etc. on the inner or outer surface of a transparent cover, instead of dispersing the light diffusion material inside. Moreover, cover 3 which diffuses light may be configured to have light diffusion characteristics by diffusion processing being performed on, instead of using the light diffusion material. For example, cover 8 may be configured to have the light diffusion characteristics by surface treatment such as emboss processing being performed on to form minute irregularities on the inner or outer surface of the transparent or by a dot pattern being printed on the inner or outer surface of the transparent cover. It is to be noted that even when the diffusion processing is performed, the light diffusion material may be further included to improve the light diffusion characteristics.

It is to be noted that it not essential that cover 3 have the function to diffuse light, and that cover 3 may be transparent to the extent that the inside of cover 3 is visible from the outside of the same.

Operation of a terminal device such as a remote controller by a user causes controller 43 to turn on and off a current output to light-emitting module 60 via first antenna 45*a* and second antenna 147*c*, thereby turning on and off luminaire 1 thus configured.

Moreover, luminaire 1 corresponds to dimming and toning functions of light-emitting module 60. The dimming function is achieved by controller 43 increasing or reducing a current output to light-emitting module 60. In addition, the toning function is achieved by controller 43 changing a balance of supply current to each of light sources 62 included in light-emitting module 60. It is to be noted that the increase or reduction of the supply current to light-emitting module 60 is performed by, for example, PWM control.

The following describes a result of measuring gains of second antenna 147*c* (third control wire 47*c*) using control wire 47 in luminaire 1 thus configured.

Figure 7:
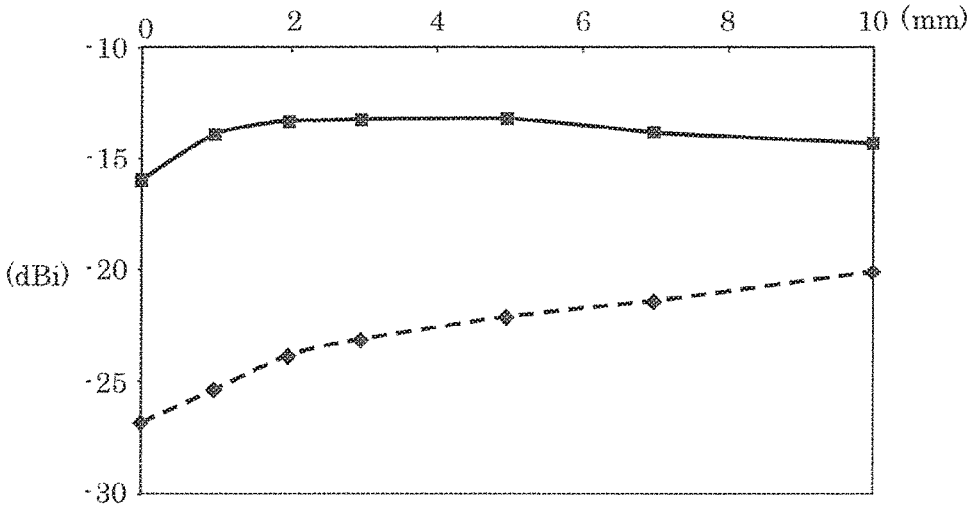
FIG. 7 is a graph illustrating a relationship between average gains of the first antenna and a second antenna and a distance from the second antenna to a base in the luminaire according to the embodiment.

FIG. 7 is a graph illustrating a relationship between average gains of first antenna 45*a* and second antenna 147*c* and a distance from second antenna 147*c* to base 41 in luminaire 1 according to the embodiment.

In FIG. 7, a solid line represents the average gain (dBi) of first antenna. 45*a*, and a broken line represents the average gain (dBi) of second antenna 147*c*. Moreover, the distance (mm) from third control wire 47*c* to base 41 represents the shortest distance from the upper end of third control wire 47*c* to the bottom surface of recess 42 in base 41.

The average gain of first antenna 45*a* increases by approximately 3 dB from the minimum value to the maximum value. In addition, the average gain of second antenna 147*c* increases at least 6 dB from the minimum value to the maximum value.

For this reason, it has been found that exposing second antenna 147*c* using third control wire 47*c* from base 41 causes the average gain of first antenna 45*a* to increase.

Figure 8:
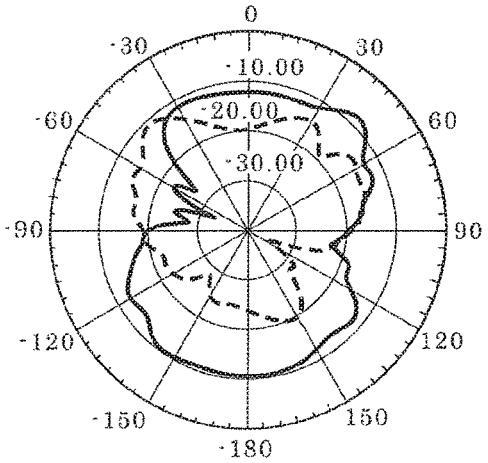
FIG. 8 is a diagram illustrating the directivities of the first antenna and the second antenna in the luminaire according to the embodiment.
Figure 9:
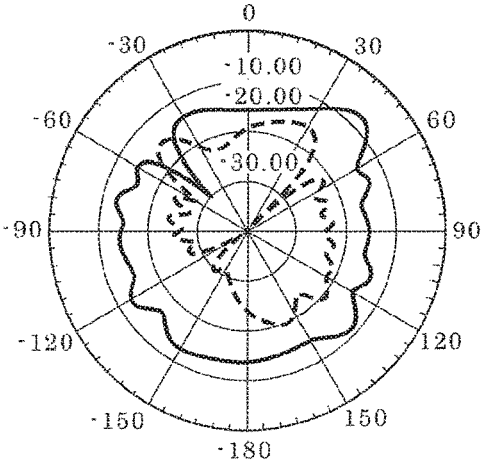
FIG. 9 is a diagram illustrating the directivities of the first antenna and the second antenna in the luminaire according to the embodiment.

Moreover, FIG. 8 and FIG. 9 each are a diagram illustrating directivities of first antenna 45*a* and second antenna 147*c* in luminaire 1 according to the embodiment. FIG. 8 shows the directivities of first antenna 45*a* and second antenna 147*c* when the distance from third control wire 47*c* to base 41 is 0 mm. FIG. 9 shows the directivities of first antenna 45*a* and second antenna 147*c* when the distance from third control wire 47*c* to base 41 is 10 mm. In FIG. 8 and FIG. 9, a solid line represents the average gain of first antenna 45*a*, and a broken line represents the average gain of second antenna 147*c*.

As shown in FIG. 8, the average gain of first antenna 45*a* is −15.31 (dBi), and the average gain of second antenna 147*c* is −26.67 (dBi).

As shown in FIG. 9, the average gain of first antenna 45*a* is −14.37 (dBi), and the average gain of second antenna 147*c* is −20.14 (dBi).

The measurement result has found that luminaire 1 is expected to obtain a greater gain when the distance from third control wire 47*c* to base 41 is greater. Accordingly, luminaire 1 can obtain the best average gain when the distance from third control wire 47*c* to base 41 is approximately 10 mm.

(a) of FIG. 10 is a perspective view illustrating the radiation intensities of first antenna 45*a* and second antenna 147*c* in luminaire 1 according to the embodiment. (b) of FIG. 10 is a partially enlarged perspective view illustrating the radiation intensities of first antenna 45*a* and second antenna 147*c* in luminaire 1 according to the embodiment.

In (a) of FIG. 10 and (b) of FIG. 10, a darker portion indicates a higher radiation intensity, and a brighter portion indicates a lower radiation intensity. From (a) of FIG. 10 and (b) of FIG. 10, it can be understood that radio waves radiated by first antenna 45*a* of wireless module 45 and second antenna 147*c* of third control wire 47*c* have a higher radiation intensity.

Comparative Example

FIG. 11 is a partial cross-sectional view illustrating luminaire 1 according to a comparative example. FIG. 11 is a cross-sectional view of luminaire 1 according to the comparative example, taken along line V-V in FIG. 1.

As illustrated in FIG. 11, control wire 47 electrically connecting wireless module 45 and controller 43 is not exposed from base 41 in luminaire 1 according to the comparative example. In other words, unlike the embodiment, control wire 47 is not provided between base 41 and cover 3. (Unlike the embodiment, exposed portion 48 is absent.)

(a) of FIG. 12 is a diagram illustrating the radiation intensity of first antenna 45*a* in luminaire 1 according to the comparative example. (b) of FIG. 12 is a partially enlarged perspective view illustrating the radiation intensity of first antenna 45*a* in luminaire 1 according to the comparative example.

Also in (a) of FIG. 12 and (b) of FIG. 12, a darker portion indicates a higher radiation intensity, and a brighter portion indicates a lower radiation intensity.

From (a) of FIG. 12 and (b) of FIG. 12, it can be understood that radio waves radiated by first antenna 45*a* of wireless module 45 has a higher radiation intensity. In addition, it can be understood that, radio waves are radiated from a space between base 41 and casing 21. By comparing (a) of FIG. 12 and (b) of FIG. 12 in the comparative example and (a) of FIG. 10 and (b) of FIG. 10 in the embodiment, it can be understood that radio waves radiated by control wire 47 are reduced by base 41. It is to be noted that portions having a higher radiation intensity at substantially regular intervals are in the horizontal direction in (a) of FIG. 10 and (a) of FIG. 12, because control wire 47 radiates the radio waves on every half-wavelength.

Advantageous Effects

Next, advantageous effects of luminaire 1 according to the embodiment will be described.

As stated above, luminaire 1 according to the embodiment includes: light-emitting module 60; base 41 having a front surface (under surface) on which light-emitting module 60 is disposed; cover 3 which is translucent and covers light-emitting module 60; controller 43 which is disposed on a back surface (top surface) of base 41 and controls light-emitting module 60; first antenna 45*a* which transmits and receives a vertically polarized wave; and control wire 47 which connects controller 43 and first antenna 45*a*. Control wire 47 includes exposed portion 48 which is a portion of control wire 47 in a longitudinal direction of control wire 47 and which is disposed between base 41 and cover 3 to transmit and receive a horizontally polarized wave that differs from the vertically polarized wave in a polarization direction.

With this configuration, because exposed portion 48 is exposed from base 41 between base 41 and cover 3, base 41 has difficulty in blocking radio waves radiated from control wire 47. For this reason, it is possible to ensure the radiation intensity of second antenna 147*c* in exposed portion 48.

Accordingly, using part of control wire 47 as second antenna 147*c* makes it possible to increase a gain to improve communication performance.

Moreover, an illumination system according to the embodiment includes a plurality of luminaires 1. The illumination system includes terminal device 101 capable of controlling the plurality of luminaires 1.

With this configuration, the same advantageous effect as that of aforementioned luminaire 1 is produced.

Furthermore, in luminaire 1 according to the embodiment, control wire 47 includes a plurality of wires. Exposed portion 48 includes second antenna 147*c* which transmits and receives the horizontally polarized wave. Second antenna 147*c* includes ground wire 147 of control wire 47.

With this configuration, ground wire 147 of control wire 47 is grounded on a side opposite controller 43. As a result, ground wire 147 of third control wire 47*c* in exposed portion 48 can be used like a dipole antenna. For this reason, ground wire 147 of third control wire 47*c* can be used as second antenna 147*c*.

It is to be noted that using ground wire 147 of control wire 47 as an antenna makes it possible to reduce an increase in the number of components.

Moreover, in luminaire 1 according to the embodiment, second antenna 147*c* is separated from base 41.

With this configuration, as illustrated in FIG. 7, the radiation intensity of second antenna 147*c* is increased, and an average gain is increased, which makes it possible to improve communication performance.

Furthermore, in luminaire 1 according to the embodiment, first antenna 45*a* extends in a direction (a vertical plane) substantially perpendicular to a ground surface. Second antenna 147*c* is linear. In addition, second antenna 147*c* extends to be substantially perpendicular to first antenna 45*a*.

With this configuration, because first antenna 45*a* transmits and receives the vertically polarized wave, and second antenna 147*c* of third control wire 47*c* transmits and receives the horizontally polarized wave, the gain is increased by these antennas having different directivities.

It is to be noted that, for example, because it is known that the average gain is decreased when a longitudinal direction of first antenna 45*a* and a longitudinal direction of exposed portion 48 are arranged to be the same direction (substantially parallel), wireless module 45 and exposed portion 48 are disposed to be substantially perpendicular to one another.

Moreover, in luminaire 1 according to the embodiment, wireless module 45 is disposed to penetrate base 41 from the front surface to the back surface. Base 41 includes first insertion hole 41*a* into which control wire 47 is inserted. Exposed portion 48 has the right end electrically connected to controller 43 via first insertion hole 41*a*. Exposed portion 48 has the left end electrically connected to wireless module 45.

With this configuration, base 41 is above third control wire 47*c* due to first insertion hole 41*a* which is included in base 41 and into which second control wire 47*b* is inserted. Consequently, base 41 reflects radio waves above second antenna 147*c*, which makes it possible to reduce a decline of the directivity.

It is to be noted that second control wire 47*b* inserted into first insertion hole 41*a* allows third control wire 47*c* to be easily fixed to base 41.

Furthermore, in luminaire 1 according to the embodiment, base 41 further includes second insertion hole 41*b* into which control wire 47 is inserted and which is aligned with first insertion hole 41*a* in the horizontal direction. The left end of exposed portion 48 is electrically connected to wireless module 45 via second insertion hole 41*b*.

With this configuration, first insertion hole 41*a* and second insertion hole 41*b* are not continuous unlike a long hole. Consequently, base 41 reflects radio waves above second antenna 147*c*, which makes it possible to reduce a decline of the directivity.

It is to be noted that second control wire 47*b* inserted into first insertion hole 41*a* and fourth control wire 47*d* inserted into second insertion hole 41*b* allow third control wire 47*c* to be easily fixed to base 41.

Moreover, in luminaire 1 according to the embodiment, base 41 supports circuit board 61 on which light source 62 is mounted. The front surface of base 41 includes recess 42 which is recessed to house circuit board 61. Exposed portion 48 is not on a straight line connecting light source 62 and the front surface of base 41 excluding recess 42.

With this configuration, it is difficult to block light from light source 62 due to exposed portion 48, which makes a user feel discomfort less easily. If exposed portion 48 is on the straight line connecting light source 62 and the front surface of base 41 excluding recess 42, exposed portion 48 is likely to cast a shadow. Luminaire 1, however, does not easily produce a shadow due to exposed portion 48.

Furthermore, in luminaire 1 according to the embodiment, base 41 includes recess 42 which is recessed to house circuit board 61. Exposed portion 48 is disposed in recess 42.

With this configuration, it is difficult to block light from light source 62 due to exposed portion 48, and exposed portion 48 is not easily seen via cover 3, which make the user feel discomfort much less easily.

Moreover, in luminaire 1 according to the embodiment, base 41 is long. Control wire 47 extends along base 41.

With this configuration, by disposing control wire 47 along base 41, it is possible to achieve space-saving.

Variation 1 of the Embodiment

Hereinafter, a configuration of a luminaire according to variation 1 of the embodiment will be described with reference to FIG. 13.

FIG. 13 is a cross-sectional view illustrating a state in which a cover is removed from a luminaire according to variation 1 of the embodiment. FIG. 13 is a cross-sectional view of the luminaire according to variation 1 of the embodiment, taken along line IV-IV in FIG. 5.

Variation 1 of the embodiment differs from the embodiment in that spacer 63 is provided between circuit board 61 and base 41. The other structural elements of luminaire 1 in variation 1 are the same as those of luminaire 1 in the embodiment, and description thereof is omitted accordingly.

In variation 1 of the embodiment, spacer 63 separates light-emitting module 60 from the bottom surface of recess 42 in base 41, which makes it difficult for exposed portion 48 to be on a straight line connecting light source 62 and the front surface of base 41 excluding recess 42.

Variation 2 of the Embodiment

Hereinafter, a configuration of an illumination system according to variation 2 of the embodiment will be described with reference to FIG. 14.

FIG. 14 is a schematic diagram illustrating the illumination system including luminaires according to variation 2 of the embodiment.

As illustrated in FIG. 14, illumination system 100 includes luminaires 1 and terminal device 101. In variation 2 of the embodiment, four luminaires 1 are provided to a ceiling.

Terminal device 101 is, for example, a device such as a smartphone and a single-purpose remote controller, and is capable of controlling luminaires 1. Operations such as turning on, turning off, dimming (brightness adjustment), and toning (emission color (color temperature) adjustment) of light-emitting modules 60 are performed according to an operation made with terminal device 101. It is to be noted that luminaires 1 may be individually selected, and operations such as turning on, turning off, dimming (brightness adjustment), and toning (emission color (color temperature) adjustment) may be performed using terminal device 101.

Other Variations Etc.

Although the luminaire and the illumination system according to the present disclosure have been described base on the embodiment and variations 1 and 2 of the embodiment, the present disclosure is not limited to the embodiment and variations 1 and 2 of the embodiment.

It is to be noted that in the present disclosure, a first antenna and a second antenna may be controlled such that a signal of one of the first antenna and the second antenna which has a higher radiation intensity is preferentially used, and noise of a signal received to improve signal quality, for example, may be reduced by an EMI reduction filter etc.

It is to be noted that a control wire may include first to third control wires in the present disclosure. Specifically, the third control wire has the right end which may be connected to the second control wire, and the left end which may be connected to a wireless module. In this case, base 41 may include only first insertion hole 41*a*. In other words, second insertion hole 41*b* is not an indispensable structural element.

It is to be noted that although the operations such as turning on, turning off, and dimming of the luminaire are performed using an input device in the present disclosure, the operations may be performed using an operation panel installed on a wall. In such a case, a control wire for transmitting signals between the operation panel and the luminaire is connected to the luminaire.

Moreover, in the present disclosure, the luminaire may be communicable with a program distribution server via the Internet. The luminaire may include hardware corresponding to functions, and a storage which is rewritable and is for causing the hardware to operate according to the functions. To cause the luminaire to emit light according to a function, software (program) which corresponds to the function and is for causing the hardware to operate is stored in the storage. The software may be stored in the storage in advance, or a program distributed by the program distribution server may be received by and stored in the storage. When a program distributed by the program distribution server is to be received, a user of the luminaire selects a desired function (program) using an input device such as a smartphone and a tablet terminal. Consequently, the selected program is distributed to the luminaire by the program distribution server, and the distributed program is stored into the storage in the luminaire. Accordingly, the user can use the function of the luminaire corresponding to the distributed program.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A luminaire comprising:

a light-emitting module;

a base having a front surface on which the light-emitting module is disposed;

a cover which is translucent and covers the light-emitting module;

a controller which is disposed on a back surface of the base and controls the light-emitting module;

a first antenna which transmits and receives a first polarized wave; and a control wire which connects the controller and the first antenna, wherein the control wire includes an exposed portion which is a portion of the control wire in a longitudinal direction of the control wire and which is disposed on the front surface of the base between the base and the cover, which is translucent, to transmit and receive a second polarized wave that differs from the first polarized wave in a polarization direction.

2. The luminaire according to claim 1, wherein the control wire includes a plurality of wires, the exposed portion includes a second antenna which transmits and receives the second polarized wave, and the second antenna includes a ground wire of the control wire.

3. The luminaire according to claim 2, wherein the second antenna is separated from the base.

4. The luminaire according to claim 2, wherein the first antenna extends in a vertical plane, the second antenna is linear, and the second antenna extends to be substantially perpendicular to the first antenna.

5. The luminaire according to claim 1, wherein the first antenna is disposed to penetrate the base from the front surface to the back surface, the base includes a first insertion hole into which the control wire is inserted, the exposed portion has one end electrically connected to the controller via the first insertion hole, and the exposed portion has the other end electrically connected to the first antenna.

6. The luminaire according to claim 5, wherein the base further includes a second insertion hole into which the control wire is inserted and which is aligned with the first insertion hole in the longitudinal direction, and the other end of the exposed portion is electrically connected to the first antenna via the second insertion hole.

7. The luminaire according to claim 1, wherein the base supports a circuit board on which a light source is mounted, the front surface of the base includes a recess which is recessed to house the circuit board, and the exposed portion is not on a straight line connecting the light source and the front surface of the base excluding the recess.

8. The luminaire according to claim 7, wherein the base includes the recess which is recessed to house the circuit board, and the exposed portion is disposed in the recess.

9. The luminaire according to claim 1,
wherein the base is long, and
the control wire extends along the base.

10. An illumination system comprising:
a plurality of the luminaires according to claim 1; and
a terminal device capable of controlling the plurality of the luminaires.

11. The luminaire according to claim 1, wherein the control wire extends from the back surface of the base to the front surface of the base so as to provide the exposed portion on the front surface of the base.

* * * * *